United States Patent [19]

Dörnemann

[11] Patent Number: 4,853,241

[45] Date of Patent: Aug. 1, 1989

[54] PROCESS FOR TREATING AGRICULTURAL PRODUCTS WITH PESTICIDES ON SHIPS

[75] Inventor: Manfred Dörnemann, Frankfurt am Main, Fed. Rep. of Germany

[73] Assignee: Degesch GmbH, Fed. Rep. of Germany

[21] Appl. No.: 133,338

[22] Filed: Dec. 15, 1987

Related U.S. Application Data

[62] Division of Ser. No. 819,691, Jan. 10, 1986, Pat. No. 4,729,298.

[30] Foreign Application Priority Data

Feb. 4, 1985 [DE] Fed. Rep. of Germany ..... 3503650

[51] Int. Cl.[4] ..... A23K 1/00

[52] U.S. Cl. ..... 426/320; 426/335; 426/532; 426/623; 426/630; 422/28; 422/32

[58] Field of Search ..... 426/320, 321, 326, 335, 426/532, 419, 623, 630; 422/28, 32; 435/161

[56] References Cited

U.S. PATENT DOCUMENTS

| | | | |
|---|---|---|---|
| 856,354 | 6/1907 | Martin et al. . | |
| 3,041,684 | 7/1962 | Dawson et al. | 422/32 |
| 3,097,916 | 7/1963 | Dawson et al. | 422/32 |
| 3,239,360 | 3/1966 | Dixon | 426/419 |
| 3,486,241 | 12/1969 | Coyle et al. | 426/419 |
| 3,997,400 | 12/1976 | Hedén | 435/161 |
| 4,059,048 | 11/1977 | Dickson | 99/482 |
| 4,078,480 | 3/1978 | Luck | 99/476 |
| 4,200,657 | 4/1980 | Cook | 422/32 |
| 4,509,682 | 4/1985 | Heiman et al. | 239/60 |
| 4,579,714 | 4/1986 | Gunn | 422/32 |
| 4,651,463 | 3/1987 | Friemel | 422/32 |

*Primary Examiner*—R. B. Penland

*Attorney, Agent, or Firm*—Leydig, Voit & Mayer

[57] ABSTRACT

A process and equipment for disinfecting bulk foods or animal feeds on a ship are described. According to this process, either before beginning to fill the cargo hold or when beginning the loading operation, a fumigation system is placed in the cargo hold and includes line sections that extend from the loading hatch to the bottom of the hold and are provided with gas passages at least in the vicinity of the bottom of the hold, and after filling the cargo hold, the end of the fumigation system which projects cut of the bulk material is connected to a centrifugal fan and the preparation which releases the gas is placed on in the surface of the bulk material and the fan is turned on and the cargo hold is sealed so that it is airtight. By operating the fan, the gas is pulled out of the gas space above the bulk material and directed into the bulk material from the bottom through the fumigation system. The system according to this invention includes a fan which is connected to a number of line sections that are joined together, in which case the line section in the vicinity of the bottom of the cargo hold is provided with gas passages for the gas to escape into the bulk material.

9 Claims, 1 Drawing Sheet

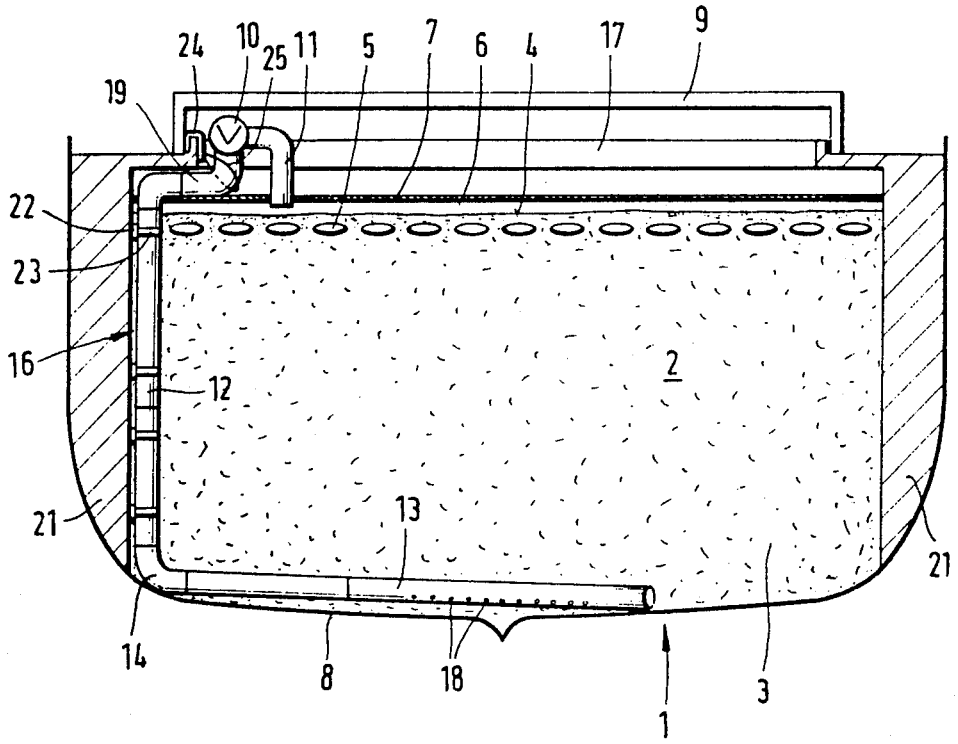
24
10
25
11
5
7
6
4
17
9
19
22
23
16
12
2
21
13
21
14
8
18
3
1

PROCESS FOR TREATING AGRICULTURAL PRODUCTS WITH PESTICIDES ON SHIPS

This application is a division of application Ser. No. 819,691 filed Jan. 10, 1986, now issued as U.S. Pat. No. 4,729,298.

FIELD OF THE INVENTION

This invention concerns the use of a process for disinfecting bulk foodstuffs or animal feeds in an enclosed room whereby an agent that releases phosphine is placed on or beneath the surface of the bulk material and the air above the bulk material which becomes enriched with phosphine is circulated through the bulk material at a flow rate of 0.005 $m^3/min.m^3$ or less, and a device for disinfecting bulk foods on ships whereby a preparation that releases a pesticide is placed on or beneath the surface of the bulk material and the air above the bulk material which becomes enriched with pesticide is circulated through the bulk material.

BACKGROUND OF THE INVENTION

In order to prevent agricultural products, especially bulk foods such as grains, from becoming unusable on ships, a treatment with pesticides is necessary.

To do so, the bulk material is sprayed with a liquid insecticide, but the agent acts only at the surface and kills only the pests that come in contact with the surface. Such agents do not destroy the developing stages from egg to pupa. Another disadvantage is that the liquid insecticides and their residues cannot be removed from the bulk material subsequently.

In another process, the bulk material is fumigated with methyl bromide or hydrogen cyanide. However, a disadvantage of the treatment with methyl bromide is that almost all the gaseous methyl bromide collects near the bottom due to its high specific gravity and thus is not available for the desired purpose in a sufficient concentration in the entire volume of stored bulk food. In addition, there is the problem of the presumed carcinogenic effect of gaseous methyl bromide which raises questions regarding unlimited international use of this preparation in the future.

Similar use of hydrogen cyanide also raises the objection of its great power of adhesion to the surface of the bulk material and thus inadequate depth of penetration.

Another method of eliminating pests is fumigation with a preparation that releases phosphine and has been performed in the past by either

- introducing the preparation in the form of pressed tablets into the bulk material by means of a probe, or
- adding the preparation in the form of pellets or tablets by means of a metering device into the stream of bulk material flowing through the loading hatch, or
- adding the preparation to the bulk material in the form of bags which contain the preparation which releases phosphine by either throwing the bags, pulling them in with special tools or placing them on the surface of the bulk material.

The process for introducing pellets or tablets by means of a probe is very labor-intensive, and the depth of penetration is limited to a maximum of 10 meters because the probes must be introduced into the bulk material with physical force. The depth of the bulk packing on a ship may reach up to 25 meters, however.

A uniform distribution of the gas is possible only after a long period of time, so destruction of the pests is not assured in this way. Furthermore, the residues remain in the bulk material.

Introduction of pellets through a metering device is connected with disadvantages in those cases when the bulk material is not introduced continuously through a conveyor device, but instead by means of a bagger, because the preparation and thus the gas are not uniformly distributed in the bulk material.

Use of bags also leads to an uneven distribution of the gas because the bags cannot be introduced at random into the bulk material. In order to avoid these disadvantages, the bags must be added to the feed stream. Since the bags must be removed from the bulk material, a screening or sorting step is also necessary.

Recently, there have been attempts to eliminate the disadvantages of the processes known in the past by placing preparations in the form of bags and chains of bags that release phosphine on or directly beneath the surface of the bulk food material in order to facilitate introduction and subsequent removal.

However, this method has a disadvantage that, depending on the depth of the stored bulk material, it may take several days to achieve the required gas concentration in the entire bulk material. Furthermore, the concentration which develops between the surface of the bulk material and the cover, i.e., the loading depth, may become so high that it greatly exceeds the lower explosion limit.

Furthermore, when using the above-mentioned preparations in so-called "in-transit shipboard fumigation," there is the risk that quantities of gas that are harmful for the crew might enter personal quarters intended for the crew, recreation rooms, mess halls, bridges, machine room, etc., and thus represent a latent hazard for the crew. Cases are also known where fires erupted due to shifting of the chains of bags and local accumulations, posing a direct threat to the ship and crew.

German Pat. (OLS) No. 2,945,334 describes a process for treatment of agricultural products stored in a container whereby a product is introduced into a storage vessel, air is supplied to the storage vessel, a gaseous chemical agent which has a minimal sorption with respect to the product is introduced into the storage vessel and air and the chemical agent are circulated through the product within the vessel at a low velocity of flow by means of the air supplied until a uniform distribution of the chemical agent in the entire product is achieved. The rate at which the air is circulated is lower than about 0.005 $m^3/min.m^3$ and is preferably between 0.0012 $m^3/min.m^3$ and 0.0006 $m^3/min.m^3$. The preferred chemical agent is phosphine, which is produced from aluminum phosphide or magnesium phosphide.

The equipment described in this publication and needed for carrying out the process is not suitable for ships due to its design, but instead is suitable only for stationary silos. The equipment necessary for carrying out this process is thus considerably more complex and is suitable only for a stationary installation in a silo.

SUMMARY OF THE INVENTION

The present invention is therefore based on the goal of creating a process for disinfecting bulk food materials on ships of the type characterized initially which will permit simple and reliable handling in comparison with the processes known in the past and will assure largely complete penetration of the product with pesticides with minimal use of preparations.

Accordingly, this invention provides a process for disinfecting bulk material such as food stuffs or feeds, the process comprising the steps of placing a fumigation system in the cargo hold and filling the cargo hold with the bulk material. The fumigation system includes line sections which extend from the vicinity of the loading hatch to the bottom of the cargo hold and which are provided with gas openings at least in the area of the bottom of the cargo hold. The process further comprises the steps of connecting an end of the fumigation system which projects out of the bulk material to a fan, placing an agent that releases a gaseous pesticide such as phosphine on or below the surface of the bulk material. The air above the bulk material then becomes enriched with the gaseous pesticide. Further, the process comprises the steps of operating the fan so the air above the bulk material which is enriched with the pesticide is circulated through the bulk material and sealing the cargo hold so it is air tight.

As a result of this special sequence of measures, it is possible for the operating crew to perform the fumigation of the bulk material in the hold using simple means. The fumigation system which includes various detachable line sections is introduced before the cargo hold is filled with the bulk material so no special effort is necessary. In the area of the bottom of the cargo hold, the fumigation system has holes through which the gas can enter or escape, depending on whether fumigation of the bulk material is to be from top to bottom or from bottom to top. The preparation releasing the gas which is placed at or in the surface of the bulk material is preferably in the form of plastic plates into which the pesticide has been incorporated by sintering, and these plates are produced either individually or in the form of strips to permit simple removal after conclusion of the fumigating operation. After the circulating fan has been turned on, the cargo hold is sealed airtight so as to yield effective destruction of pests and avoid any health risk for the operating personnel.

In an especially advantageous manner, by operating the circulating fan, the gas is discharged from the gas space above the bulk material and directed into the bulk material from the bottom by means of the fumigation system because this process has proven especially advantageous for achieving optimum fumigation of the material in a container within a relatively short period of time and at low cost.

Preferably the gas is introduced into the bulk material essentially in the vicinity of the middle so the gas spreads like a "weather front" uniformly from the bottom of the hold starting at one area filling all spaces and from top to bottom during the treatment period, thus assuring an optimum and uniform concentration. This is promoted by the fact that the space above the bulk material has a uniform pressure distribution and thus no channels develop in the bulk material.

Magnesium phosphide is used as the preparation which forms the pesticide because of the rapid release of phosphine from the moisture content of the material, because this has proven especially advantageous for this process.

Preferably a pneumatic fan is used which yields at least one complete exchange of air within 24 hours and assures largely complete fumigation of the bulk material. Such a fan is preferred in order to reduce the risk of explosion which exists when phosphine exceeds a critical concentration of 17,000 ppm. The pneumatic fan may be designed as a vane type fan, etc., which supports a slight inherent movement of the gas and in this way achieves at least one complete exchange of air (according to the air displacement principle) and largely complete fumigation of the bulk material within a maximum of 24 hours, depending on the power of the fan and the flow resistance of the bulk material.

The fumigation system may be suspended from the loading hatch or detachably mounted on the side walls of the hold, preferably with magnets. By suspending the fumigation system from the loading hatch with devices specially provided for the fumigation system, it is simple to adjust the mounting of the fumigation system in the loading hatch depending on the type of ship, because the end which has the openings for the gas must be located in the vicinity of the bottom of the cargo hold and, on the other hand, a simple method of mounting is achieved. The fumigation system can also be attached to the side walls in a simple manner, e.g., by means of magnets. The fan is connected to the fumigation system, as described above, and the entire arrangement including the fan can also be located beneath the airtight cover. If the fan must be located above the cover, airtight ducts must be provided accordingly to the fumigation system and in the gas space above the bulk material.

Either one or more fumigation systems may be used, depending on the size of the cargo hold and how much bulk material is placed in it.

The velocities of flow required for fumigation correspond largely to the velocities as disclosed in German Pat. (OLS) No. 2,945,334.

The goal of a device of the type characterized initially is solved according to this invention by the fact that line sections are provided which have a total length that can be adjusted to the depth of the bulk material in the hold, so that one end of the line sections that are joined together reaches the bottom of the cargo hold of the ship while the other end is in the vicinity of the loading hatch, gas passages are provided for the pesticide in the line sections in the vicinity of the bottom of the cargo hold, a centrifugal fan is provided in connection with the other end of the line sections that are joined together and the line sections are detachably mounted on the hull.

The detachable line sections may be designed as tubing which has a sufficient inherent strength to resist the pressure of the bulk material loaded into the cargo hold. The line sections are preferably detachably connected by means of screw connections or similar connections and are made of plastic or preferably of a nonferrous metal because of the weight. The gas passages for the pesticide are located on the side facing the bottom of the cargo hold or on the fore side of the end of the line.

The line sections may be made in different basic lengths so the system can be adapted to all types of ships. The line sections may also be manufactured as disposable articles by having a suitable number of line sections provided along with the pesticide preparations by the pesticide manufacturer or distributor, depending on the amount of pesticide preparation, which in turn depends on the amount of bulk material to be fumigated and thus on the size of the ship's cargo hold, so the user is also supplied with the tools necessary for optimum application of the pesticide. The line sections can thus be adapted to the bulk material in an advantageous manner.

The pumps that are also used with the line sections can be reused, so it is not necessary for these pumps to accompany the pesticide preparation. It is also advantageous for such a system to be very simple to assemble and operate. For example, when a ship which is equipped with several cargo chambers is filled slowly, a pump can be connected to line sections projecting out of the bulk material after the first cargo compartment has been filled and fumigation can be performed while the next compartment is being loaded. After conclusion of the fumigation, the pump is disconnected from the line section and used for the next compartment or the one after that.

Depending on whether the pump is located directly at the surface of the bulk material or above the cover of the bulk material, a line section must also be detachably mounted on the other side of the pump and the line sections must pass through the cover.

The gas passage openings for the pesticide should be located in the vicinity of the bottom of the cargo hold in order to achieve a good distribution of the gas, and the gas passage openings should face the bottom of the cargo hold in order to prevent blockage of the openings, especially on the periphery of the line section in question. The area of the device located in the vicinity of the bottom of the cargo hold may also have several detachably connected line sections so as to assure an optimum adaptation to the width of the type of ship in each case.

It is advantageous for the line sections in the intended use to run largely parallel with the wall of the ship and the bottom. This means that the line sections in the vicinity of the bottom of the cargo hold must be bent or curved to form the line sections in the vicinity of the wall of the ship. The same thing may also occur in the vicinity of the cargo hold opening when the loading hatch is considerably smaller than the ship. Then a bend is also necessary to keep the line sections as close as possible to the ship's wall to avoid damage and for the purpose of securing it. The bend may be achieved by means of suitable pipe bends which are also included in the application set which may accompany the pesticide preparations.

The mounting and attachment of the line sections is preferably accomplished by mounting the line sections detachably at the loading hatch and/or on the ship's wall. For mounting at the loading hatch, a device may be provided, e.g., with cables and a hook, whereby the hook can be suspended at the hatch and the line sections are adapted in height to the ship's height by means of the cables. An advantageous method of mounting the device is by means of magnets that are permanently or detachably provided on the line sections and by means of which the system can be secured to the ship's wall.

If the amount of bulk material to be fumigated is too large for one system to perform the fumigation within a reasonable period of time, then several line sections which have gas openings around the periphery may be connected together in the vicinity of the cargo hold bottom and these in turn are connected to line sections that are similarly joined together and run in the vicinity of the ship's wall. In this way, sufficient fumigation can be achieved even in large ships by means of several systems that have been joined together, e.g., diagonally, laterally or in the form of a cross. Preferably all line sections projecting out of the bulk material are connected to one fan as needed and are designed identically.

With the process described above for fumigation according to this invention, a simple and reliable method of applying the pesticide is achieved which has not previously been possible on ships in any other way. In addition, the device according to this invention is easy to handle, can be adjusted to any type of ship and represents a great facilitation of the job for the personnel in question.

BRIEF DESCRIPTION OF THE DRAWING

The accompanying FIGURE shows in a diagram form a cross section through a ship's hull illustrating a fumigation system according to the present invention.

DESCRIPTION OF THE PREFERRED EMBODIMENT

The accompanying FIGURE illustrates one practical example in greater detail. THIS FIGURE shows in diagram a cross section through a ship's hull whereby the width of the loading hatch is much smaller than the width of the total ship. In the interior of the ship's hull 1 there is the cargo hold 3 which holds the bulk material 2 beneath the surface 4 of which the pesticide preparations 5 are located. From the edge of the loading hatch 17 to the bottom 8 of the hold 3 there extends a fumigation system 16 which includes several detachably connected line sections, e.g., pipes 12 and 13 running along the ship's wall 21 and the bottom 8. Line sections 13 extending along the bottom 8 of the cargo hold are connected to line sections 12 extending along the ship's wall by means of a bend 14. At the end of line sections 13 in the vicinity of the middle of the ship, there are gas passages 18 for the pesticide located on the periphery, especially the side facing the bottom 8 of the hold and on the fore end. At the opposite end of the fumigation system there is a fan which projects by means of another line section 11 into space 6 between the surface 4 of the bulk material and airtight cover 7. Near the end 19 of the fumigation system 16 facing the fan 10, the fumigation system is attached to the edge of the hatch 17. This may be accomplished by means of hook 24 which holds the fumigation system 16 by means of a cable 25. In addition, the fumigation system 16 is also supported on the bottom 8 of the cargo hold. For further mounting to the ship's wall 21, magnets 22 are provided on the line sections 12 by means of plastic strips 23, for example, to assure an additional hold to the ship's wall 21. The entire system 16 may also be sealed inside the cargo hold 3 by means of a hatch cover 9.

For larger hatches 17, no additional bends 14 are required in the vicinity of end 19.

If the depth of the bulk material is greater than illustrated here, fan 10 may under some circumstances also have to be located further up on the hatch cover 9.

By the process according to this invention, the pesticide phosphine is directed from the hollow space 6 into the vicinity of the bottom 8 of the cargo hold beneath the bulk material 2 by means of the fumigation system 16 and is directed there into the bulk material 2 through gas openings 18.

I claim:

1. A process for disinfecting bulk foods or animal feeds in a cargo hold of a ship by an agent that releases gaseous phosphine pesticide, said process comprising the steps of:

(a) detachably mounting in the cargo hold a fumigation system including line sections extending from the vicinity of a loading hatch to the bottom of the cargo hold and provided with gas openings at least in the area of the bottom of the cargo hold;

(b) filling the cargo hold with the bulk material;

(c) connecting an end of the fumigation system which projects out of the bulk material to a fan;

(d) placing the agent on or below the surface of the bulk material whereby the air above the bulk material becomes enriched with the gaseous pesticide;

(e) operating the fan so the air above the bulk material which is enriched with the gaseous pesticide is circulated through the bulk material; and (f) sealing the cargo hold so it is air tight.

2. The process according to claim 1 wherein operating the fan includes circulating the air enriched with gaseous pesticide through the bulk material at a velocity of flow of about 0.005 $m^3/min \times m^3$ or less.

3. The process according to claim 1 wherein operating the fan includes removing a gas from a gas space over the bulk material and directing it into the bulk material from below by the fumigation system.

4. The process according to claim 3 wherein directing the gas into the bulk material includes directing the gas into the bulk material essentially in the area of the middle of the hull.

5. The process according to claim 1 wherein placing the agent includes placing on or below the surface of the bulk material plastic plates which have the pesticides sintered into them, said plates being used either individually or in the form of strips.

6. The process according to claim 1 wherein connecting the end of the fumigation system to a fan includes connecting the end of the fumigation system to a pneumatic centrifugal fan and wherein operating the fan includes achieving at least one complete exchange of air and a largely complete fumigation of the bulk material within twenty-four hours.

7. The process according to claim 1 wherein detachably mounting the fumigation system includes detachably mounting the fumigation system at the loading hatch.

8. The process according to claim 7 wherein detachably mounting the fumigation system includes attaching the fumigation system to the ship with magnets.

9. The process according to claim 1 wherein detachably mounting the fumigation system includes detachably mounting the fumigation system on the side walls of the cargo hold.

* * * * *